United States Patent [19]

Bronnert

[11] Patent Number: 5,050,670

[45] Date of Patent: Sep. 24, 1991

[54] FOUR PIECE ELBOW FOR A MULTI-TUBE HEAT EXCHANGER

[76] Inventor: Hervé X. Bronnert, 21495 Partridge Ct., Brookfield, Wis. 53005

[21] Appl. No.: 558,633

[22] Filed: Jul. 26, 1990

[51] Int. Cl.[5] ..... F28D 7/06

[52] U.S. Cl. ..... 165/163; 165/159; 29/890.036

[58] Field of Search ..... 165/159, 163; 29/890.036

[56] References Cited

U.S. PATENT DOCUMENTS

| | | | |
|---|---|---|---|
| 1,924,272 | 8/1933 | Coffin, Jr. | 122/441 |
| 2,844,360 | 7/1958 | Buri | 165/163 X |
| 3,253,326 | 5/1966 | Henry et al. | 29/890.036 |
| 4,432,123 | 2/1984 | Minning et al. | 29/890.036 |
| 4,884,629 | 12/1989 | Bronnert | 165/159 |

FOREIGN PATENT DOCUMENTS

| | | | |
|---|---|---|---|
| 1084678 | 7/1960 | Fed. Rep. of Germany | 29/890.036 |

*Primary Examiner*—Allen J. Flanigan
*Attorney, Agent, or Firm*—Foley & Lardner

[57] ABSTRACT

A multiple tube heat exchanger formed from a number of elbow members which when combined form a "U" shaped jacket, an elongate tubular section connected to the ends of the U-shaped jacket, a number of heat conductive U-shaped tubular members mounted in the jacket, a tube sheet mounted on the ends of said tubular members and tubular sections and a number of baffles for supporting the tubular members in a spaced relation from said tubular sections.

8 Claims, 2 Drawing Sheets

FOUR PIECE ELBOW FOR A MULTI-TUBE HEAT EXCHANGER

FIELD OF THE INVENTION

The present invention relates to multiple tube and shell type heat exchangers and more particularly to an improved multiple piece U-shaped jacket for enclosing said tubes. The jacket is formed by a plurality of tubular elbows which are independently mounted on the tube bundles and then secured to each other to form the U-shaped end of the jacket.

BACKGROUND OF THE INVENTION

A multiple tube and shell type heat exchanger for heating or cooling liquid products is shown and described in my U.S. Pat. No. 4,884,629 entitled High Pressure Multiple Tube and Shell Type Heat Exchanger issued on Dec. 5, 1989. In this patent the U-shaped section of the jacket is described as being formed of two identical half sections of 180° each of which, when assembled, form the U-shaped end of the jacket. Although used successfully, the splitting of one 180° elbow longitudinally into two 180° half sections requires a large rugged and rigid bandsaw with the necessary tubing to accurately guide the elbow through the saw to form the cut. This requires considerable time and patience in order to obtain identical half sections. The longitudinal cut through the elbow produces a disruption in the force/stress lines of the elbows. The two identical half sections were then welded together after mounting on the tube bundle. Accurate alignment of the longitudinal sections proved difficult due to the inability to hold the sections in alignment during welding.

SUMMARY OF THE INVENTION

The present invention relates to a U-shaped water jacket for a multiple tube heat exchanger which is formed from three or more elbows of 60° or less. The elbows are independently mounted on the tube bundles and then welded end to end to achieve an improved stress distribution throughout the 180° turn. With this arrangement the circumferential welds are parallel to the direction of highest stresses and do not weaken the hydraulic pressure resistance of the elbow.

One of the primary advantages of the present invention is the ability to achieve a better and sounder mechanical stress distribution in the 180° end of the water jacket.

A further advantage is the ease and simplicity in welding circumferential welds as opposed to longitudinal welds in 180° half sections.

A further advantage of the present invention is the ease of assembly of the elbows which decreases both time and cost of manufacture.

Other principal features and advantages of the invention will become apparent to those skilled in the art upon review of the following drawings, the detailed description and the appended claims.

DETAILED DESCRIPTION OF THE DRAWINGS

Figure 1:
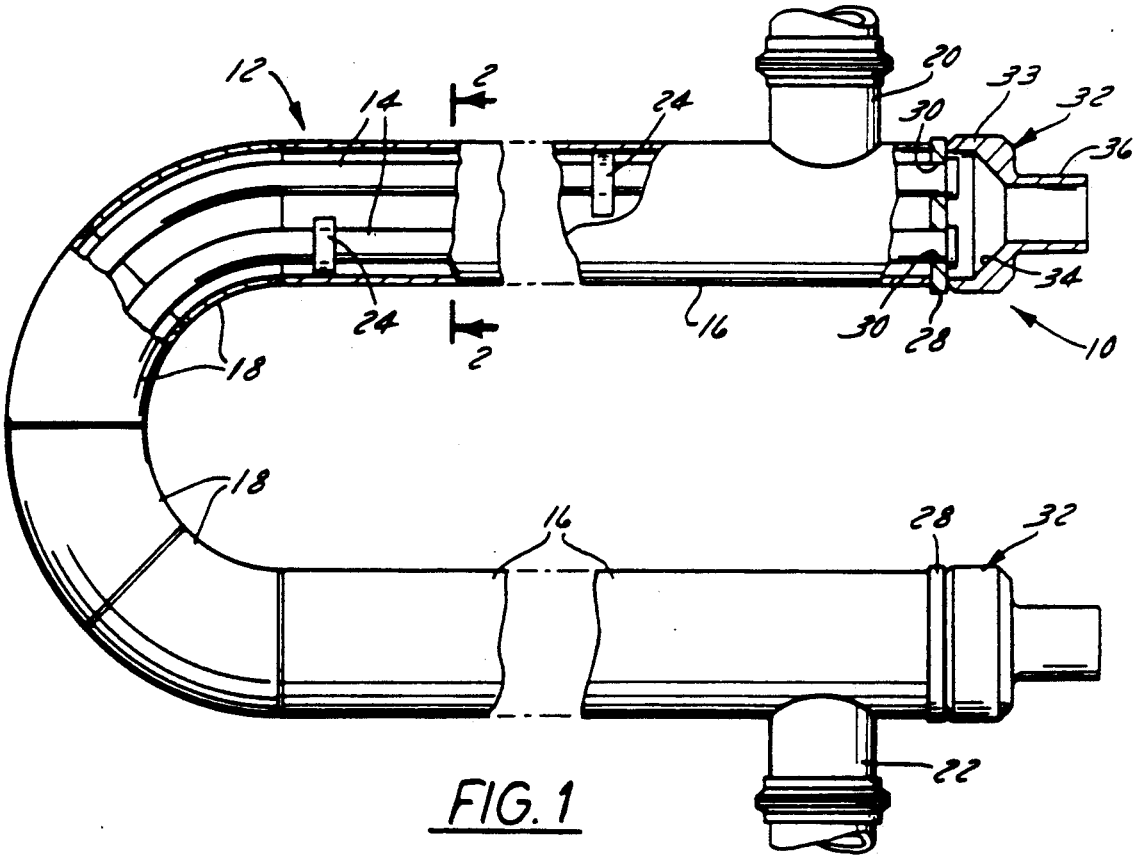
FIG. 1 is a side elevation view of a high pressure multiple tube heat exchanger having a four piece U-shaped section with a portion of the jacket removed to show the spacing of the tubular members.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Referring to the drawings, a high pressure multiple tube shell type heat exchanger 10 is shown which is used for heating or cooling various types of liquid products. The heat exchanger 10 may be utilized for any application requiring high pressure liquid flow at high velocity wherein the product is to be heated or cooled by a heat exchange medium such as steam, hot water, ice water, glycol, etc.

As seen in FIG. 1, the heat exchanger 10 generally includes a jacket or shell 12 of a substantially U-shape and having a number of U-shaped tubular members 14 mounted in a spaced relation within the jacket. The shell 12 is formed by a pair of elongate tubular sections 16 and four 45° elbow sections 18. The jacket 12 may be supported by any conventional frame structure either in a vertical or horizontal relation to one another.

The ends of the tubular section 16 are provided with an inlet 20 and an outlet 22 for permitting a heat exchange medium to circulate through the jacket at a pressure of 0–200 PSIG and at a velocity of 0–15 feet per second. Inlet 20 can be connected to a suitable source of a pressurized heat exchange medium such as hot water and the outlet connected directly to piping connected to a return duct not shown. The outlet 20 can be connected to the inlet of an adjacent heat exchange jacket.

The tubular members 14 are formed of heat conductive material preferably of uniform cross-section and arranged in a predetermined relatively spaced, substantially parallel relation in the form of tube bundles. The number, size, arrangement and cross-sectional shape of the tubular members 14 may vary from that shown in U.S. Pat. No. 4,884,629.

Figure 2:
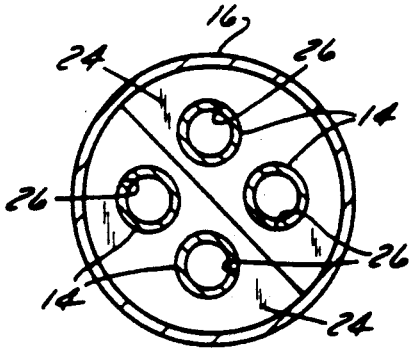
FIG. 2 is a view taken on line 2—2 of FIG. 1 showing the spacing of the tubular members within the jacket section.
Figure 4:
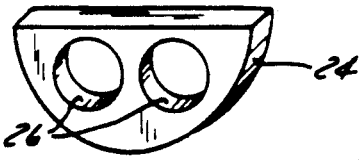
FIG. 4 is a perspective view of one of the baffles for holding the tubes in the jacket.

The tubular members 14 are spaced within the jacket 12 by means of baffles 24 as shown in FIGS. 2 and 4. Each baffle has a substantially semicircular configuration and a pair of openings 26 of the same diameter as the tubular members 14. The baffles 24 are mounted on the tubular members 14 in a perpendicular relation to the axis of the jacket. Successive baffles 24 are spaced at approximately 12 inch intervals and are offset positioned 180 about the jacket axis. The curved outer periphery of each baffle 24 conforms substantially to the curvature of the interior of the jacket section 16. Each baffle 24 is frictionally retained in a selected position within the jacket sections and will move slightly with respect to the jacket interior surfaces to compensate for any expansion or contraction of the tubular members 14 when the heat exchangers are in an operational mode. Rotating of successive baffles 180° facilitates circulation of the heat exchange medium throughout the jacket without portions of the medium becoming trapped between successive elements. There are no baffles in the U-shaped sections of the tubular members 14 in order to allow the U-shaped end of the tubular members 14 to expand and contract within the jacket.

The ends of the jacket section 16 are closed by means of tube sheets 28 which are welded to the open ends of the jacket sections 16. Each of the tube sheets 28 includes a number of openings 30 corresponding to the number of tubular members 14 which are provided within the jacket. The ends of the tube sheets 14 can be sealed as described in U.S. Pat. No. 4,884,629. In this regard, it should be noted that only the ends of the tubular members 14 are secured to the tube sheets 28 and the spacers 24 are frictionally retained within the jacket so that expansion and contraction of the tubular members are not inhibited and thus the connection between the tubular members and the tube sheets and the connection of the tube sheets and the jacket ends are not adversely affected.

The ends of the jacket sections 16 are closed by means of adapter pieces 32 which are mounted on the edges of the tube sheets 28. Each adapter piece 32 is provided with a large collar 33 which abuts the rim of the tube sheet 28. The inner surface of the collar includes a tapered section 34 which communicates with a reduced end section 36. The inside dimension of the end section 36 is substantially equal to the sum of the inside dimensions of the tubular members 14.

Figure 3:
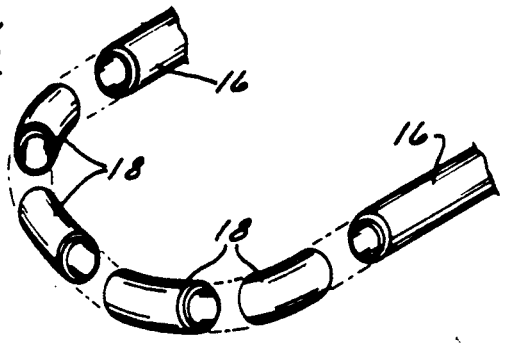
FIG. 3 is an exploded view of the end of the U-shaped jacket showing the four 45° sections.
Figure 5:
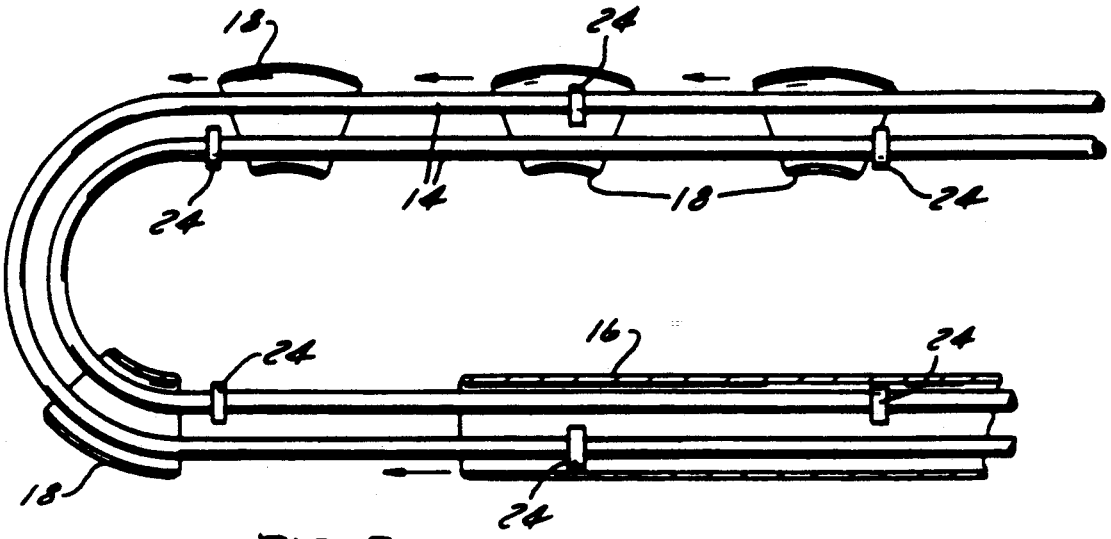
FIG. 5 is a view partly in section showing the assembly of the four elbow sections on the tube members.
Figure 6:
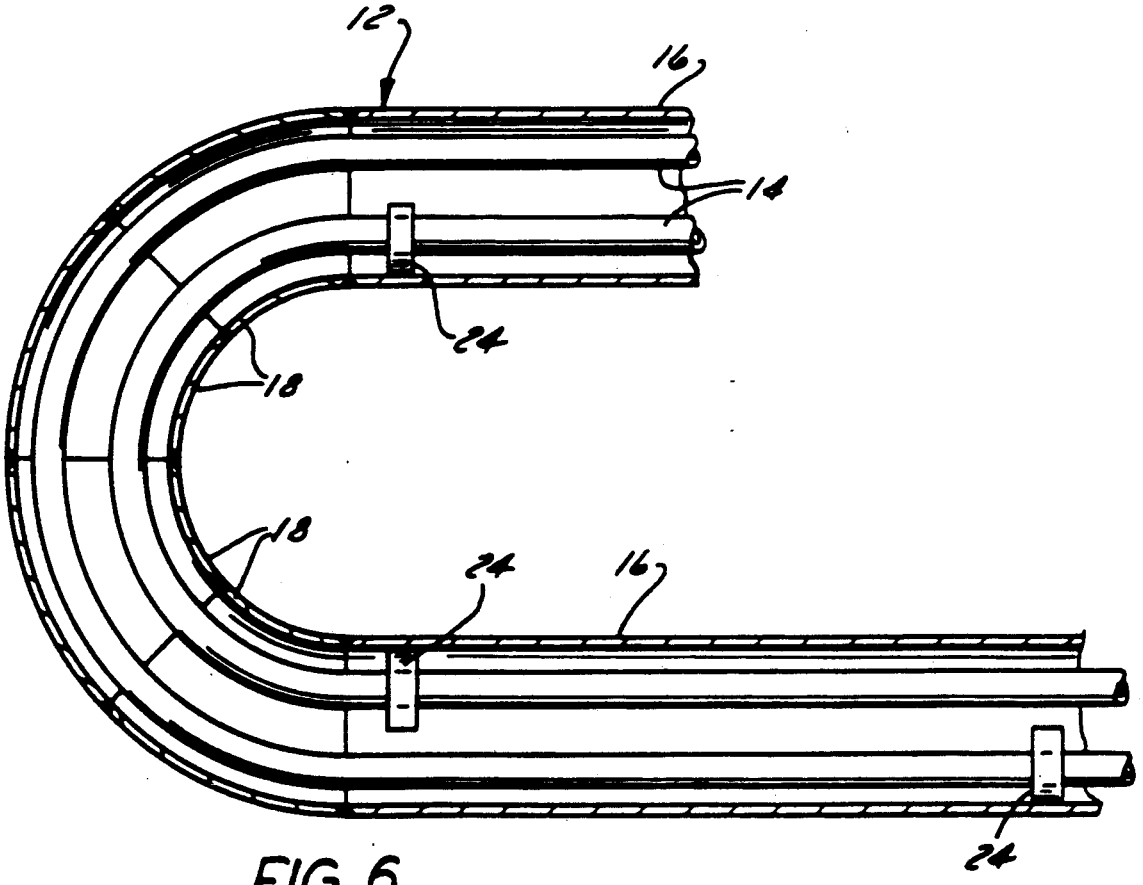
FIG. 6 is a view partly in section showing the spacing of the tubular members within the U-shaped jacket.

Referring to FIGS. 3, 5 and 6 the heat exchanger is assembled by initially aligning the elbow sections 18 on the tubular members 14 as shown in FIG. 5. It should be noted that the U-shaped sections are in the form of 45° elbows. The elbow sections 18 are moved over the tubular members 14 and baffles 24. The sections 18 are then circumferentially welded together to form the U-shaped end of the jacket. The tubular sections 16 are then mounted on the ends of the elbow members 18 by sliding the sections 16 over the baffles 24 into engagement with the ends of the U-shaped jacket formed by the elbow sections 18. Once the tubular sections 16 have been aligned with the elbow sections 18 they are welded together to form the jacket. Although 45° elbows have been disclosed, it is possible that incremental elbows of 60°, 33° or 22½° could also be used to form the U-shaped end of the jacket. The heat exchanger is completed by attaching the tube sheets 28 to the end of the tubular sections 16 and tubular members 14.

Thus, it should be apparent that there has been provided in accordance with the present invention a four piece elbow for a multi-tube heat exchanger that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A high pressure, multiple tube and shell type heat exchanger comprising:

a substantially U-shaped jacket having a heat exchange medium inlet disposed adjacent one end thereof and a heat exchange medium outlet disposed adjacent a second end thereof;

said jacket being formed from a number of curved, one piece elbow sections, said elbow sections being affixed in an end to end relationship to form a sealed U-shaped end section, an elongate, one piece tubular section connected to each end of said U-shaped end section to form a sealed jacket, each of said elbow sections and said elongate tubular sections being equal in cross sectional diameter to provide a constant heat exchange rate throughout said jacket, a plurality of heat conductive tubular members arranged in relatively spaced, substantially parallel relation and disposed within said jacket and through which a high pressure product flows, each tubular member having a substantially U-shape conforming to the shape of said jacket, and a tube sheet affixed and sealingly mounted on each end of said jacket, each tube sheet being provided with an opening for engaging the end of each of said tubular members.

2. The heat exchanger according to claim 1 including a number of semicircular baffles supporting said tubular members in a parallel spaced relation in said tubular sections.

3. The heat exchanger according to claim 2 wherein said baffles are secured to said tubular members and frictionally engage said tubular section.

4. The heat exchanger according to claim 1 wherein said jacket includes three or more elbows.

5. The heat exchanger according to claim 2 wherein said elbow sections are forty-five° elbows.

6. A process for assembling the components of a high pressure, multiple tube and shell thyme heat exchanger comprising the steps of:

forming a number of U-shaped tubular members into a bundle, sliding a number of elbow sections over said tubular members to form a jacket around the U-shaped end of said tubular members, welding said elbow sections together to form a sealed U-shaped jacket, sliding an elongate tubular section over the tubular members into engagement with the sealed U-shaped jacket, welding the tubular sections to the U-shaped jacket, and securing a tube sheet to said tubular sections and tubular members.

7. A high pressure, multiple tube and shell heat exchanger comprising a number of curved, one piece tubular elbow sections connected in an end to end relation to form a "U"-shaped end section, a tubular elongate section mounted on each end of said end section to form a sealed jacket, each of said elbow sections and said tubular elongate sections being equal in cross sectional diameter to produce a constant heat exchange rate through said jacket, a number of U-shaped tubular heat conductive members positioned in said jacket, and a tube sheet mounted on each end of said jacket and said tubular members.

8. The heat exchanger according to claim 7 including a number of baffles mounted on said tubular members for holding said tubular members in a spaced relation to said elongate sections of said jacket.

* * * * *